United States Patent [19]

Willett et al.

[11] 4,276,459

[45] Jun. 30, 1981

[54] PADDLE SWITCH SAFETY BUTTON

[75] Inventors: Daniel E. Willett, West Springfield; John A. Boothroyd, Amherst; William F. Langlais, Greenfield, all of Mass.

[73] Assignee: Ingersoll-Rand Company, Woodcliff Lake, N.J.

[21] Appl. No.: 159,912

[22] Filed: Jun. 16, 1980

[51] Int. Cl.[3] ..... H01H 3/20; H01H 21/04

[52] U.S. Cl. ..... 200/157; 200/321; 200/327; 200/334

[58] Field of Search ..... 200/334, 157, 321, 327, 200/328

[56] References Cited

U.S. PATENT DOCUMENTS

| | | | |
|---|---|---|---|
| 3,311,728 | 3/1967 | Brenzen | 200/157 |
| 3,549,844 | 12/1970 | Chambers | 200/157 |
| 3,873,796 | 3/1975 | Worobec, Jr. | 200/157 |

*Primary Examiner*—Willis Little

*Attorney, Agent, or Firm*—Walter C. Vliet

[57] ABSTRACT

A paddle switch safety button which prevents the paddle switch from being activated prior to the safety button being depressed. A unique multi cross section stem of the safety button cooperates with a U-shaped cutout in the paddle switch lever. The stem interferes with the lever in its extended position and passes in the U-shaped notch in the depressed position to allow the paddle switch lever to be operated.

3 Claims, 4 Drawing Figures

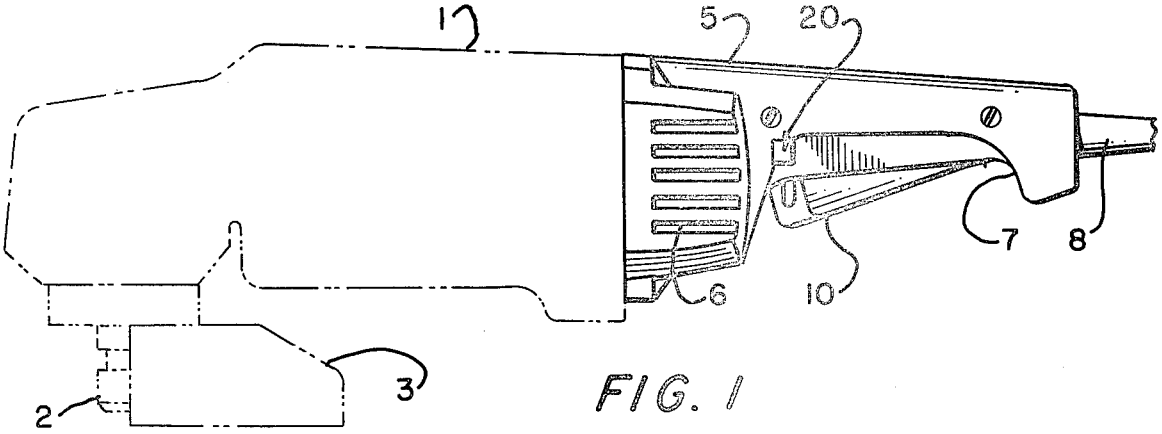
FIG. 1
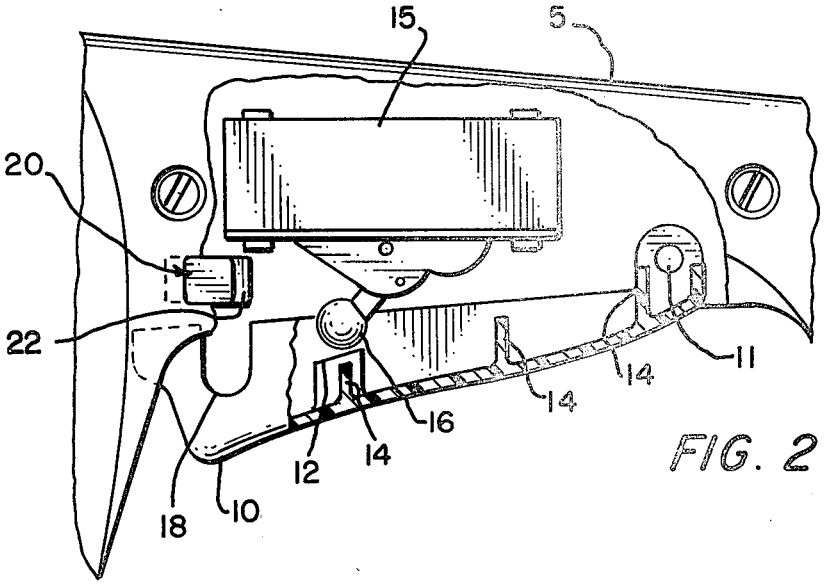
FIG. 2
FIG. 3
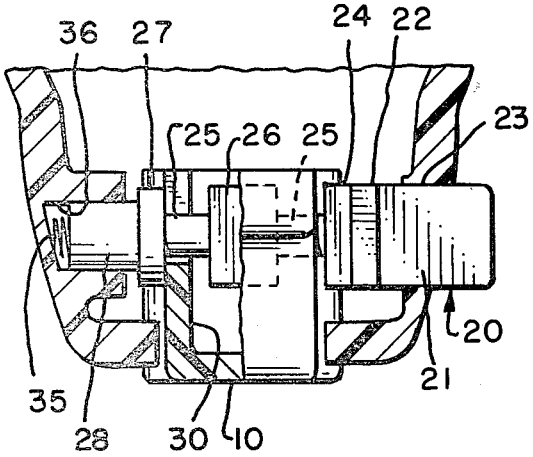
FIG. 4
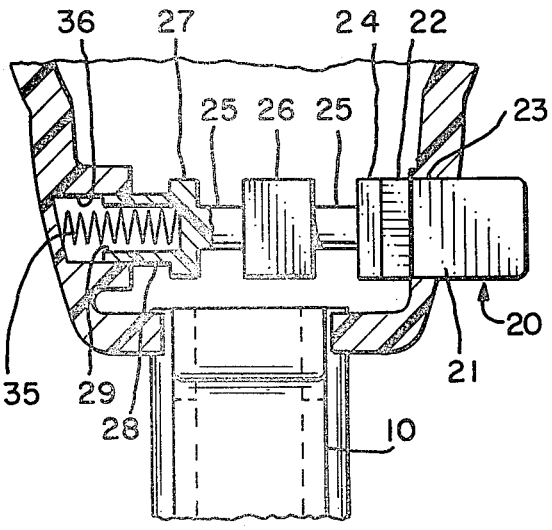

PADDLE SWITCH SAFETY BUTTON

BACKGROUND OF THE INVENTION

Paddle switches have been popular for activating power tools, especially in tools which required prolonged operation. The paddle switch results in less operator fatigue because the whole hand rather than one or two fingers may be used to depress the switch. A disadvantage of the paddle switch is if the operator picks up the tool casually or carelessly, it is easy to turn the tool on inadvertently. Numerous injuries have resulted from inadvertent operation of power tools.

SUMMARY OF THE INVENTION

The object of this invention is to provide a safety button which must be depressed prior to the operation of the paddle switch and will reset only upon release of the paddle switch lever.

The further object of the invention is to provide a safety button which holds itself in the disengaged position once the paddle switch has been activated.

A further object is to provide a simple, safe and reliable safety button which is convenient and easy to use and compatible with modern manufacturing technology including plastic housings and components.

These and other objects are obtained in a paddle switch safety switch button comprising: An elongate paddle switch lever attached to a tool at its one end by pivot means; a recess formed in the other end of the paddle switch lever; a safety button means mounted for translation along an axis perpendicular to the longitudinal axis of the elongate paddle switch lever; a first portion of the safety button means having a cross section which fits into the recess; and a second portion of the safety button means having a cross section which interferes with the paddle switch to prevent its rotation about the pivot means, whereby the paddle switch is prevented in its operation.

BRIEF DESCRIPTION OF THE DRAWINGS

FIG. 1 is a side elevation view of an electric motor driven grinder having a paddle safety switch and safety button according to this invention;

FIG. 2 is a partially sectioned side elevation showing the paddle switch in detail;

FIG. 3 is a partially sectioned elevation taken about section 3—3 showing the safety switch in its depressed position with the paddle switch lever fully depressed; and FIG. 4 is a partially sectioned elevation taken about section 3—3 showing the push button in its extended position and the paddle switch lever in its normal off position.

DESCRIPTION OF THE PREFERRED EMBODIMENT

FIG. 1 shows a typical installation of the safety button and paddle switch of the present invention in a conventional electric power grinder. The grinder body is generally shown by reference numeral 1. The grinder has a work output arbor 2 surrounded by a guard 3. The handle portion of the grinder is designated by reference numeral 5. The handle portion has cooling louvers 6 which are provided for circulation of the cooling air in an electric power motor (not shown). The handle 5 is in the form of a convenient axially extended handle grip having a finger stop 7 which prevents accidental slip of the operator's hand off the handle.

A paddle switch 10 is provided in the handle for easy operation by the fingers of the operator which in normal operation wrap around the handle 5 of the grinder. A safety push button 20 is provided in a convenient location on the handle whereby in normal right handed operation, the operator may conveniently depress the safety switch with his thumb or other part of his hand prior to activation of the paddle switch lever by his fingers.

FIG. 2 shows the details of construction of the paddle switch lever 10 which is essentially an elongated lever which is pivotally mounted to the handle 5 by means of a pivot pin 11. The paddle switch lever 10 is also provided with a U-shaped cutout 18 which is transverse to the longitudinal axis of the paddle switch at its end opposite the pivot pin. The U-shaped cutout 18 cooperates with the safety button to accomplish the purpose of this invention and will be more fully described.

A contact land 12 cooperates with a conventional on-off toggle switch 15. As can be seen by inspection of FIG. 2, when the paddle switch lever is fully depressed in the direction of the handle, the contact land 12 will push against the operating toggle 16 of the toggle switch causing the switch to move to its "on" position. Power is then supplied from power cord 8 (best seen in FIG. 1) through the toggle switch to the electric motor wherein it is converted to output rotation which rotates spindle 2. To facilitate rigidity in construction of the paddle switch lever, several reenforcing webbs 14 are provided in the generally hollow, generally cup-shaped form of the elongated lever which forms the paddle switch lever.

The handle is provided with a safety button 20 which is stratigically located to interfere with the depression of the paddle switch operating lever in its normal position. As best seen in FIG. 4, the safety button is comprised of a multi-sectioned core element. Starting from right to left, the core element is square in cross section in the projecting push button area 21. A transverse projecting rectangular cross section at 22 is provided which forms a stop to prevent the push button from being ejected to the right through a square hole 23 formed in the handle. The core member returns to the rectangular cross section of the button at portion 24. The central portion of the core element is comprised of two circular sections 25 which are identical and two extended rectangular sections which form a stop. The two circular sections have a diameter which will fit into the U-shaped cutout 18 in the paddle switch. The two extended rectangular sections extend substantially beyond the circular sections and will not fit into the U-shaped cutout 18.

The wider of the two extended rectangular sections 26 fits into the cup shaped section 30 of the paddle switch operating lever when the push button safety button is depressed. The second extended rectangular section 27 is displaced to the left of the cup shaped section of the paddle switch operating lever (as shown on FIG. 3) when the safety button is depressed. As shown on FIG. 4, to the left of the second extended rectangular section 27 is a circular section 28 which is bored out to form a spring recess 29. The recess forms a guide and retains a spring 35 which normally biases the push button to the right. The circular section 28 which retains the spring cooperates with a circular bore 36 which is formed in the handle housing as a plunger guide.

FIG. 4 shows the safety switch in its extended position. As can be seen, the paddle switch operating lever 14, if depressed upwards, would contact the extended rectangular portions 26 and 27 of the safety button core and would be prevented from further upward movement. In this position, the extended rectangular cross section portions 26 and 27 bridge the U-shaped notch or cutout 18. However, when the safety button is depressed to the left as shown in FIG. 3, the circular cross sections 25 fit into the U-shaped cutout and, therefore, allow the paddle switch operating lever to be depressed to the point of activating on-off toggle switch 15.

This is an important safety feature in that the paddle switch operating lever cannot be accidentally depressed without the safety button being also simultaneously depressed. Once the paddle switch operating lever has been depressed, it is unnecessary to hold the push button safety switch in again until the paddle switch operating lever has been released and returned to its initial extended position as shown on FIG. 4.

While we have described our invention in terms of a paddle switch safety button means for an electric power tool, it should be obvious to one skilled in the art that the invention is applicable to pneumatically or hydraulically operated tools as well, and the paddle switch could be used to depress a pneumatic or hydraulic valve to turn on the power tool. In this case a valve would replace electric switch 15 in its position. A suitable valve would be one such as an aerosol or spool valve having a substantially linear operated stem which could be operated by the contact land 12 in the same manner as the operating toggle 16 of the toggle switch. The power cord 8 would be replaced by an air or hydraulic line plumbed through the valve to an air motor replacing the electric motor in the power tool of the embodiment described.

Having described our invention, we do not wish to be limited in the scope of the invention except as claimed.

We claim:

1. A safety switch assembly comprising:

a substantially linear elongate paddle switch lever attached to a tool at its one end by pivot means;

said paddle switch lever having a hollow U-shaped cross-section with a recess formed in each of the opposite wall sections of the "U";

said recess being formed in the other end of said paddle switch lever;

a safety button means mounted for translation along an axis perpendicular to the longitudinal axis of said elongate paddle switch lever;

a first portion of said safety button means having a cross section which fits into said recess;

a second portion of said safety button means having a cross section which interferes with said paddle switch lever to prevent its rotation about said pivot means, whereby the paddle switch is prevented in its operation;

said safety button means being located towards the other end of said paddle switch lever;

said safety button means being comprised of a multi cross section plunger element which coacts with said recess when said safety button means is translated along its axis from its normal position to its depressed position; and said safety button means being biased towards its normal position by a spring.

2. A safety switch assembly according to claim 1 wherein:

said safety button means has a plurality of reduced cross sections which cooperate with a plurality of recesses formed in said paddle switch lever.

3. A safety switch assembly according to claim 1 wherein:

said paddle switch lever operates an electrical switch means to turn on a power tool.

* * * * *